US005398444A

United States Patent [19]

Murray

[11] Patent Number: 5,398,444

[45] Date of Patent: Mar. 21, 1995

[54] ADJUSTABLE TREE STAND

[76] Inventor: Kenneth J. Murray, P.O. Box 1007, Fairview, Oreg. 97204

[21] Appl. No.: 157,601

[22] Filed: Nov. 23, 1993

[51] Int. Cl.[6] ..... A47G 7/02

[52] U.S. Cl. ..... 47/40.5; 248/181; 248/515

[58] Field of Search ..... 248/515, 520, 538, 181; 47/40.5

[56] References Cited

U.S. PATENT DOCUMENTS

| | | | |
|---|---|---|---|
| 1,769,127 | 7/1930 | Finnegan . | |
| 2,044,192 | 6/1936 | Templin, Jr. . | |
| 2,513,027 | 6/1950 | Kruczek | 248/181 |
| 2,613,899 | 10/1952 | Wagner et al. . | |
| 2,928,633 | 3/1960 | Holmes et al. . | |
| 3,073,558 | 1/1963 | Klotz . | |
| 3,298,642 | 1/1967 | Taylor | 248/181 |
| 3,582,028 | 6/1971 | Purdy . | |
| 3,588,025 | 6/1971 | Gersman | 298/181 |
| 3,715,095 | 2/1973 | Drablowski . | |
| 3,885,763 | 5/1975 | Blom . | |
| 4,913,395 | 4/1990 | Juhas | 47/40.5 |
| 5,159,780 | 11/1992 | Molthen . | |
| 5,301,462 | 4/1994 | Hornyete | 47/40.5 |

*Primary Examiner*—Henry E. Raduazo

*Attorney, Agent, or Firm*—Chernoff, Vilhauer, McClung & Stenzel

[57] ABSTRACT

A stand for supporting the trunk of a tree in an easily adjustable attitude. A clamp can be securely attached to a lower portion of a tree trunk in such a manner that the clamp is immovable with respect to the trunk. A collar extends radially about the clamp and has a convex surface that has a downwardly-facing convex spherical surface and defines a central opening. A base includes a socket having a concave surface shaped to engage the convex surface of the collar matingly and with sufficient friction between the mating surfaces to hold the tree in any selected position with a generally upright attitude. The attitude and orientation of a tree held in the stand are easily adjusted by slightly lifting the collar to reduce the friction between the collar and the socket while rotating or tilting the collar with respect to the socket.

7 Claims, 4 Drawing Sheets

ADJUSTABLE TREE STAND

BACKGROUND OF THE INVENTION

This invention relates to stands for holding decorative trees, especially Christmas trees, and particularly to such a stand for the display of trees in which the position of a tree is adjustable.

Tremendous numbers of families celebrate the Christmas season by displaying and decorating Christmas trees, using assorted styles of Christmas tree stands designed to perform the basic function of supporting a tree in an upright attitude.

A popular Christmas tree stand comprises a shallow dish centered below a circular ring which is supported several inches above the center of the shallow dish by three stand legs which also support the shallow dish above the floor. The lower or butt end portion of a tree trunk is guided through the center of the circular ring and pressed onto short spikes protruding up from the lower center of the shallow dish. This fixes the position of the lower end of the tree with respect to the dish. Screws are screwed inward through several threaded holes through the circular ring and make contact with the surface of the tree trunk, providing the necessary support to hold the tree in an upright attitude. Although functional, this stand requires a cumbersome and frustrating process for adjusting the attitude and orientation of a tree for display. First, it is difficult to position the end of the tree trunk on the spikes in a position such that the tree will have the desired attitude when the screws are tightened onto the tree trunk. To modify the attitude of the tree it may be necessary to reposition the end of the tree trunk on the spikes. This requires the screws to be loosened, allowing the trunk to be lifted and repositioned on the spikes. Thereafter, the screws are tightened to again provide support for the tree. Second, the tree will typically be leaning to one side in the stand requiring readjustment of the screws to place the tree into the desired attitude (e.g., usually perpendicular to the floor). Readjustment involves retracting and extending the screws threaded through the circular ring to move the tree trunk relative to the circular ring, attempting to obtain the desired attitude for the tree. Third, the vast majority of trees have branches on one side which are more aesthetically pleasing than the other side for viewing. Accordingly, the entire tree stand may require turning (together with the tree) to obtain the best rotational orientation for viewing. After rotation, a tree with a bent trunk will usually require realigning to obtain the desired attitude.

Drablowski U.S. Pat. No. 3,715,095 discloses an adjustable Christmas tree stand in which the lower end of a Christmas tree is held in an elongate cylindrical receptacle held in a stand. The attitude of the cylindrical receptacle may be adjusted by permitting a retaining pin in the stand to engage a selected one of many holes in a plate attached to the bottom of the cylindrical receptacle. The ability to select the desired attitude is limited by the availability of suitable holes on the bottom of the cylindrical receptacle. Adjusting the attitude of the tree is thus an awkward process which involves raising the tree and the cylindrical receptacle to permit repositioning of the retaining pin into the desired hole.

Holmes U.S. Pat. No. 2,928,633 discloses a tree stand having a base and a cylindrical sleeve that surrounds the tree trunk and fits into a hole in the base. The cylindrical sleeve has annular shoulders that engage an annular element defining the hole in the base, thus holding the tree erect. Holmes does not, however, incorporate any provision for adjusting the tree to a desired attitude.

Other devices for supporting a tree or the like also lack a simple way to move and securely hold a tree in a desired attitude and orientation, as shown in the following U.S. Pat. Nos.: 5,159,780, 3,885,763, 3,582,028, 3,073,558, 2,613,899, 2,044,192, and 1,769,127.

What is still needed, then, is a tree stand which is easily attached to a tree and which provides an easy way to adjust the attitude and orientation of such a tree.

SUMMARY OF THE INVENTION

The present invention overcomes the foregoing drawbacks of the prior art by providing a stand for adjustably and securely supporting the cut-off trunk of a tree in a selected attitude. In the broadest sense of the invention, a clamp is securely attached to a lower portion of the tree trunk in such a manner that the clamp is immovable with respect to the trunk. A collar having a downwardly facing convex surface extends radially about the clamp. A base includes a socket having an upwardly-facing concave surface which matingly engages the convex surface of the collar, thus supporting the collar, the clamp and the tree. This stand structure allows the attitude and orientation of an attached tree to be adjusted easily, and friction between the convex surface of the collar and the concave surface of the socket holds the clamp, and thus the tree, in the adjusted position.

In a preferred embodiment of the invention, both the convex surface and the concave surface are portions of respective nonslippery spherical surfaces which are close enough in size to nest closely together. By simply rotating and tilting the tree, thus moving the clamp and the collar with respect to the socket portion of the stand, the tree is easily aligned to the desired attitude and orientation. The nonslippery surfaces then keep the collar in the selected position in the socket and maintain the tree in the selected position. In one embodiment of the invention a locking pad can be tightened against a surface of the collar above the socket to hold the collar tightly in the socket, holding the tree more securely in the desired position.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
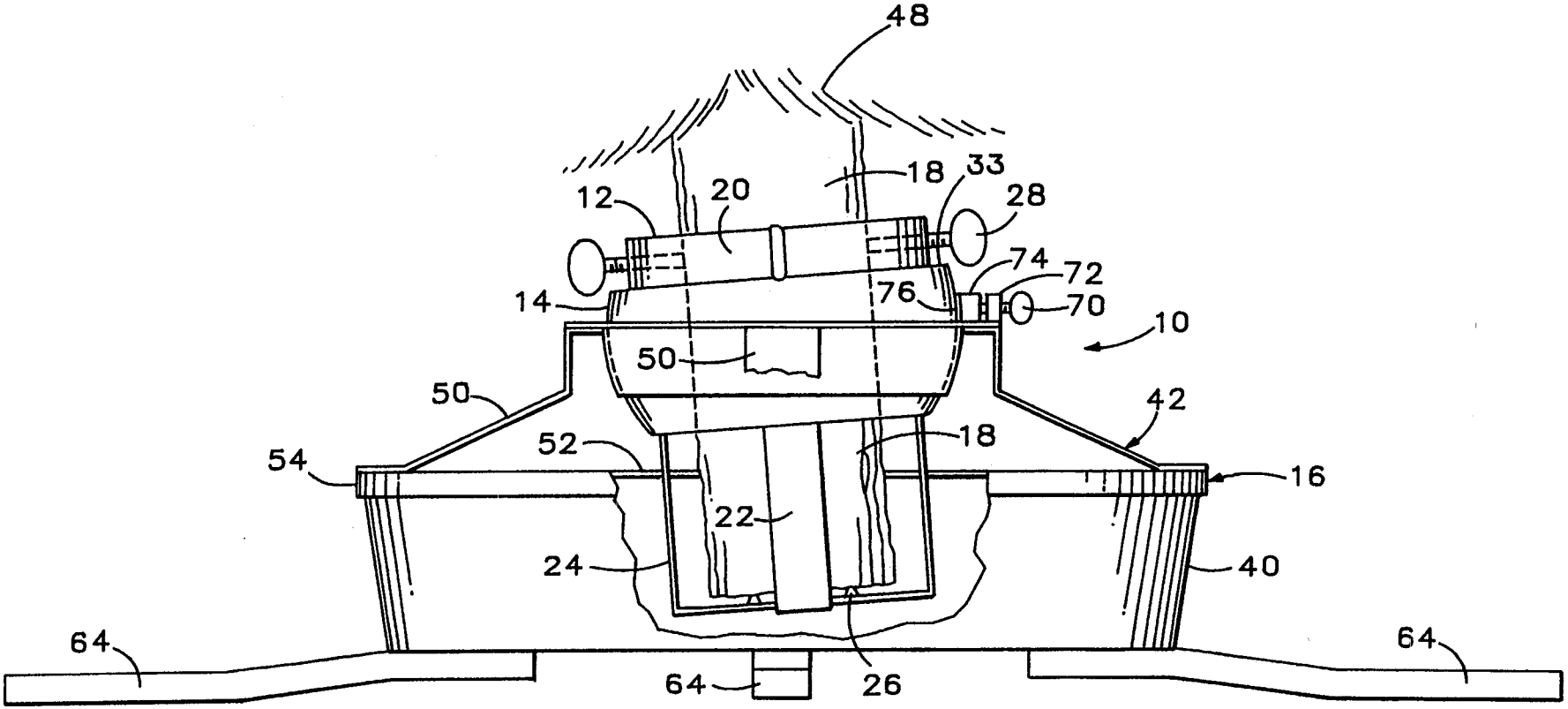
FIG. 1 is a partially cut-away elevational view of an assembled tree stand which is an exemplary embodiment of the present invention.
Figure 2:
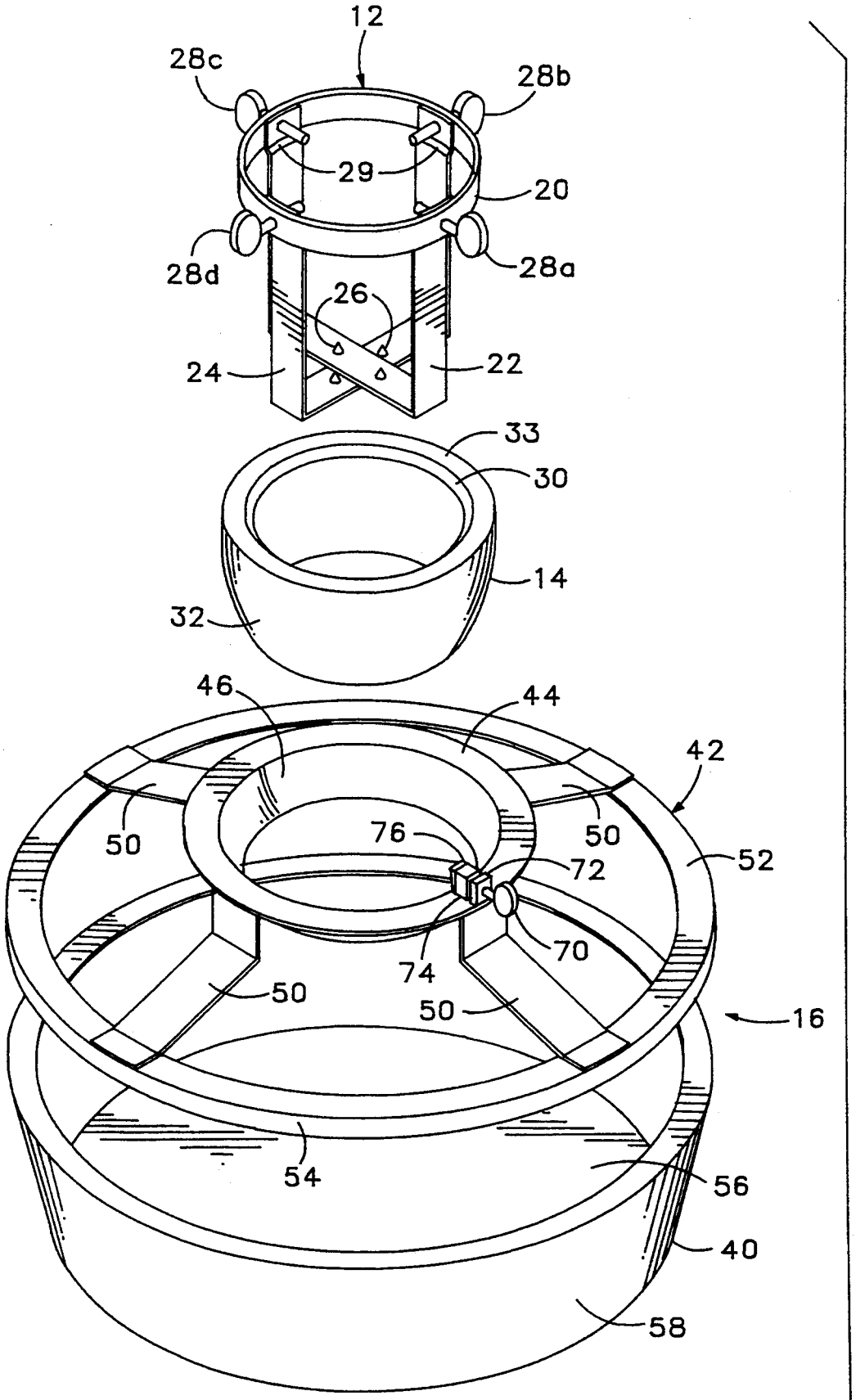
FIG. 2 is an exploded perspective view of a tree stand similar to the one shown in FIG. 1.

Referring to FIGS. 1–4, a tree stand 10 includes three major components, a clamp 12, a collar 14, and a base 16. Referring to FIG. 2, the clamp 12 is preferably made from metal straps, and includes a ring 20, a plurality of screws 28*a*, 28*b*, 28*c*, 28*d*, and a pair of U-shaped support brackets 22, 24. The end portions of the support brackets 22 and 24 are preferably welded to the inside surface of the ring 20 at four respective equally spaced-apart positions. The support bracket 22 is also affixed to the support bracket 24 where the brackets cross each other at the lower end of the clamp 12.

Both end portions of each of the support brackets 22, 24 have inwardly-directed jog bends 29. The portions of the support brackets 22, 24 defining the jog bends 29 rest against the surface of a chamfer 30 at the top of the collar 14 to ensure that the clamp 12 is supported securely by the collar 14 with the ring 20 atop the collar 14. The diameter of the ring 20 is large enough to admit the butt end portion of a tree trunk 18 to pass through the ring 20. The butt end of the tree trunk 18 should be pressed onto the spikes 26 to maintain the tree trunk 18 in a fixed position relative to the bottom of the clamp 12. The screws 28*a*, 28*b*, 28*c*, 28*d* are engaged in threaded holes defined through the ring 20 and the respective end portions of the support brackets 22, 24 and are tightened against the tree trunk 18 to securely affix the clamp 12 to the tree trunk 18 in an immovable position. The screws 28*a*, 28*b*, 28*c*, 28*d* can be individually extended or retracted, respectively, to adjust the position of the tree trunk 18 within the ring 20, thus adjusting the attitude of the tree trunk 18 relative to the clamp 12. The clamp 12 is designed with large open areas in its frame so that after assembly the tree trunk 18 can get fluid from the water pan 40.

The collar 14 is preferably made of solid plastic, and is removable from the clamp 12. The collar 14 could also be made of some other suitable material, such as stamped sheet metal or stamped sheet metal coated with plastic or rubber. The collar 14 has a downwardly-facing convex surface 32 which extends in a radial direction outwardly and arcuately upward about the clamp 12. The collar 14 also defines a central generally cylindrical circular opening designed to receive the clamp 12, and a planar annular top surface 33 surrounding a chamfered surface 30 for receiving the ring 20, including the jog bends 29, and thereby holding the clamp 12 snugly and preventing it from freely rotating in the collar 14 (see FIG. 4).

The convex surface 32 of the collar 14 mates with a concave surface 46 of the socket 44. The shapes of the concave surface 46 and the convex surface 32 are both preferably portions of respective spherical surfaces. The radius of curvature 35 of the convex surface 32 of the collar 14 should be nearly identical to the radius of curvature 37 of the concave surface 46 of the socket 44. With similar curvature the convex surface 32 and concave surface 46 can matingly engage each other to allow rotational movement of the collar 14 within the socket 44, about any selected axis, as in a ball and socket joint. The user may simply rotate and tilt the tree 48, thus moving the clamp 12 and the collar 14 with respect to the socket 44, portion of the stand 10, to easily align the tree 48 to the desired attitude and orientation.

The base 16 comprises two major components, a water pan 40 and a pan cover 42 which includes the socket 44. The upwardly facing concave interior surface 46 of the socket 44 has a nonslippery, or rough, surface which may also include engagement points 80 (see FIG. 3). The convex surface 32 preferably is nonslippery and frictionally resists movement relative to the nonslippery concave surface 46 when the two surfaces are pressed together, as by the weight of the tree 18. With the frictional resistance created by the mating of the nonslippery convex surface 32 and nonslippery concave surface 46, the orientation and attitude may be adjusted either by overcoming the friction by forcing the convex surface 32 of the clamp 12 to move relative to the concave surface 46 of the socket 44, or, preferably, by raising the tree 48 just enough to remove the pressure exerted between the convex surface 32 and the concave surface 46. After the position of the tree 18 is adjusted, the tree is allowed to settle back down, and the frictional engagement of the nonslippery surfaces 32, 46 keeps the collar 14 in a selected position in the socket 44 and maintains the tree 48 in a selected position.

The pan cover 42 also includes four radially-extending, inclined supports 50 that are welded to a bottom face 45 of the rim of the socket 44 and to the top face of a support ring 52. The supports 50 need enough strength to support the combined weight of the tree 48, clamp 12, collar 14, and socket 44. A depending wall portion 54, of the support ring 52, has a larger inside diameter than the outside diameter of the upper margin of the upstanding wall 58 of the water pan 40. The respective diameters of the retaining ring 54 and the water pan 40 help to maintain the relative position of the pan cover 42 on the water pan 40. The water pan 40 has a bottom 56 and an upstanding side wall 58 for containing fluid, such as water, for use by the tree 48.

As shown in FIG. 1, the lower portion of the clamp 12 is preferably in close proximity to the bottom 56 of the water pan 40. With the butt end of the tree trunk 18 in close proximity to the bottom 56, the amount of water required within the water pan 40 is reduced. Additionally, the tree 48 will be capable of extracting most of the water from the water pan 40, leaving only a small amount unusable. Furthermore, the stand 10 will have a low center of gravity, minimizing the likelihood of accidentally overturning the stand 10. To provide added stability, the base 16 may include four radially-extending legs 64 attached to the bottom of the water pan 40, as shown in FIG. 1.

Figure 3:
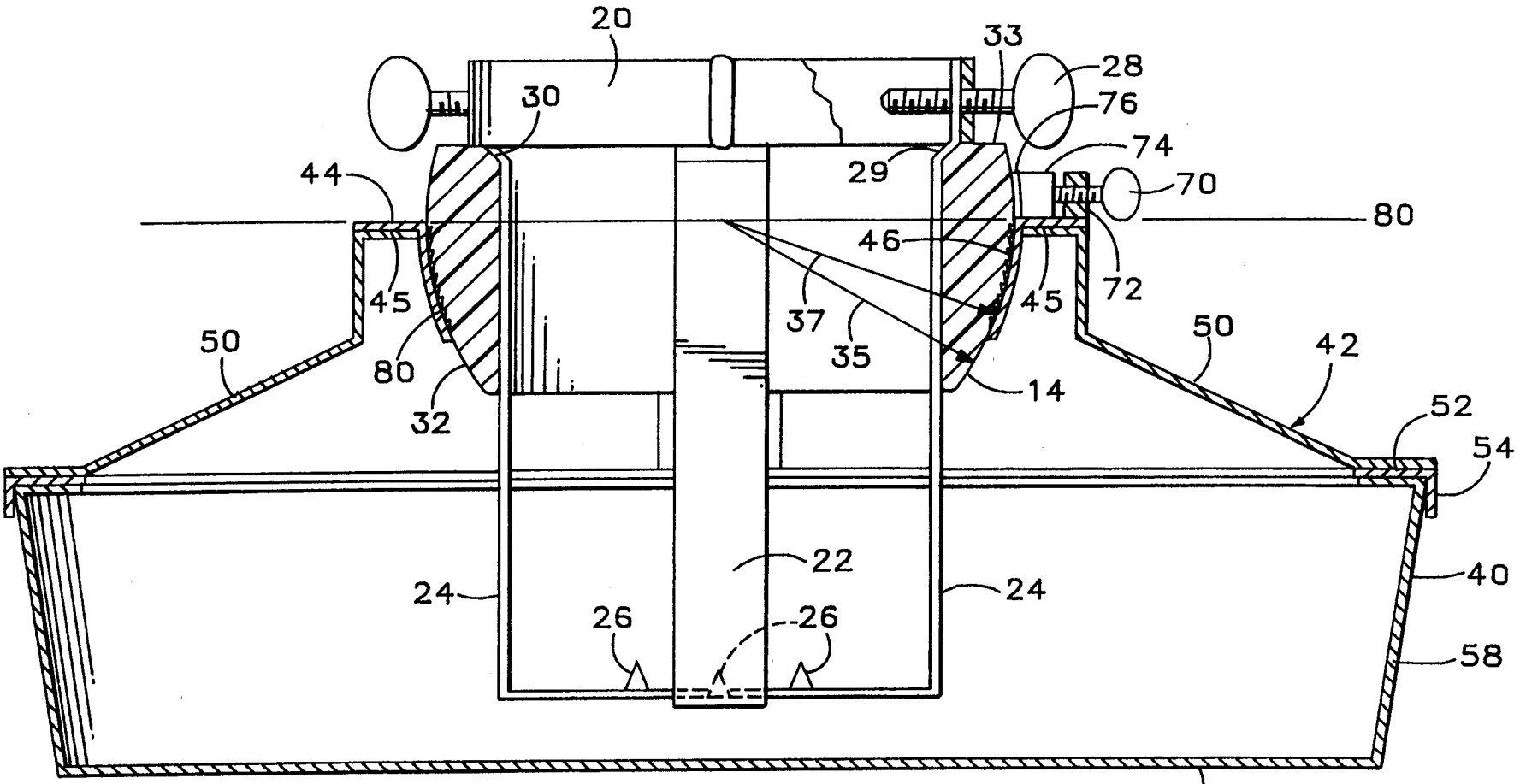
FIG. 3 is a partially cut-away sectional front view of the assembled tree stand shown in FIG. 1.
Figure 4:
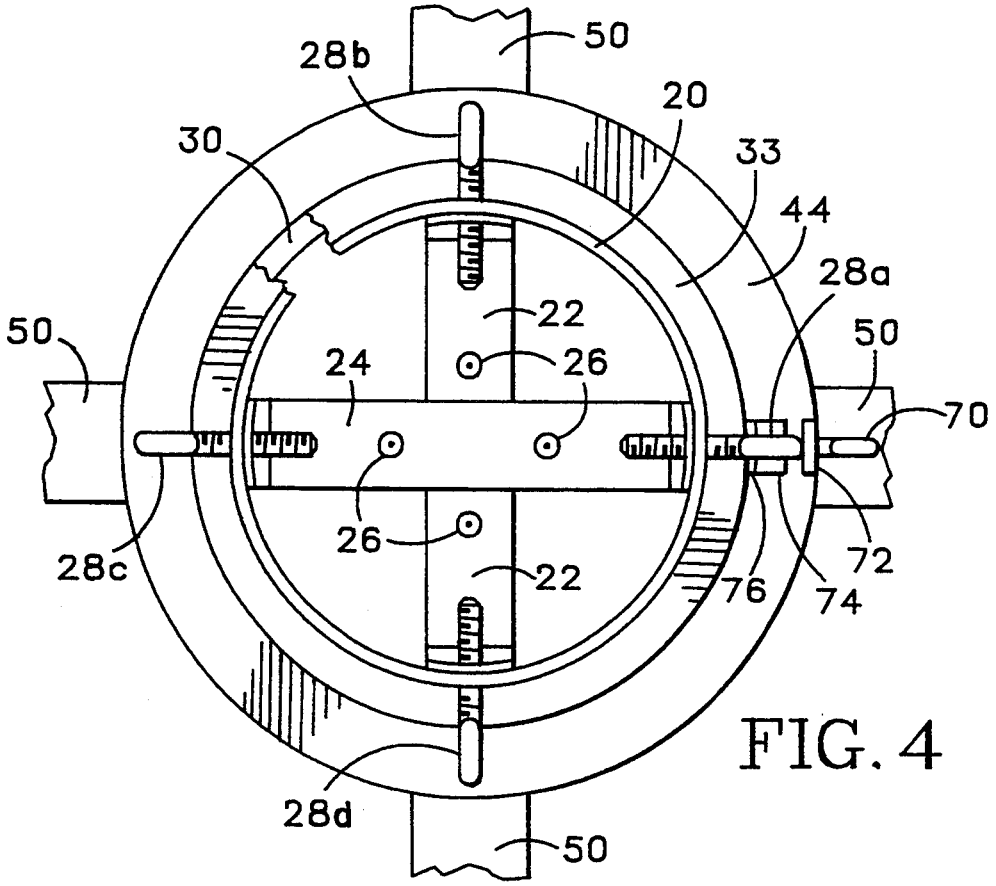
FIG. 4 is a partially cut-away top plan view of a portion of the assembled tree stand shown in FIG. 1.

Referring to FIG. 3, a screw 70 is mated in a threaded block 72 which is solidly attached to the top face of the socket 44. A locking pad 74, of somewhat resilient material such as a tough plastic, has a concave rough surface 76 for mating with the convex surface 32. After alignment of the tree 48, the screw 70 can be tightened, thereby pressing the surface 76 against the collar 14 at a position above the equator 80 of the imaginary sphere of which the concave surface 46 defines an uppermost portion of a lower hemisphere so that the collar 14 is pressed down into the socket 44 by the locking pad 74. The top of the socket 44 coincides with the equator 80 of an imaginary sphere of which the interior surface 46 of the socket 44 is preferably the upper portion of the lower hemisphere. Thus, the portion of the collar 12 extending above the socket 44 is, in effect, a portion of the upper hemisphere of the imaginary sphere, and pressure of the pad 74 against that part of the collar 12 urges the collar 12 downward into the socket 44. The pad 74 thus provides additional pressure of the convex surface 32 of the collar 14 against the concave surface 46 of the socket 44 to maintain the relative positions of the collar 14 and the socket 44.

Figure 5:
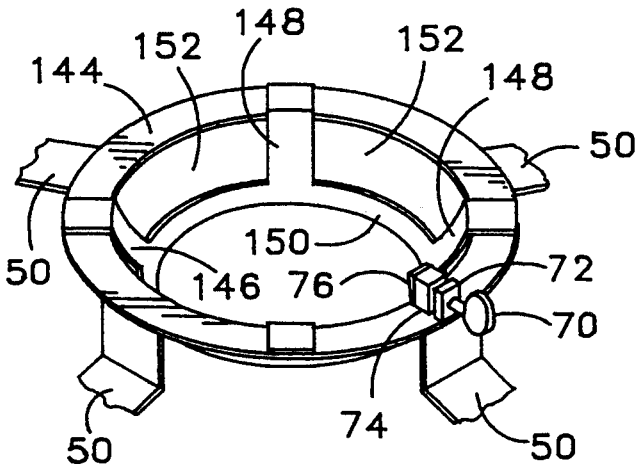
FIG. 5 is a perspective view of the socket portion of the base of a tree stand which is an alternative embodiment of the invention.

FIG. 5 shows a socket 144 which is an alternative embodiment of the socket 44 wherein the concave surface 146, corresponding to the surface 46, is discontinuous, as by including openings 152 defined by curved radial support straps 148 and an annular ring 150 defining parts of the surface 146. The support straps 148 and ring 150 defining the concave surface 146 should have sufficient strength to support the collar 14, clamp 12 and tree 48.

Figure 6:
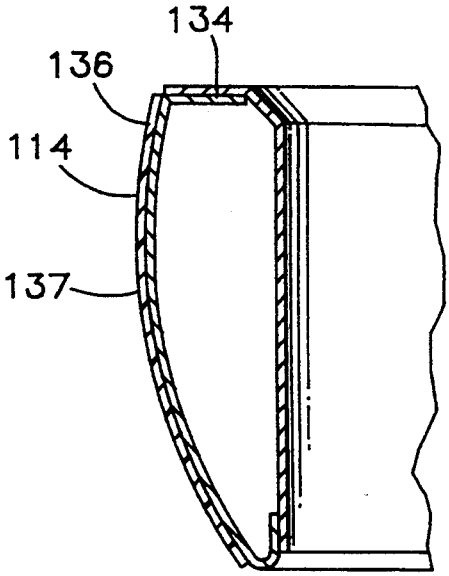
FIG. 6 is a sectional view of a collar part of a tree stand which is an alternative embodiment of the invention.

Referring to FIG. 6, a collar 114 which is an alternative design of the collar 14 is formed of sheet metal 134 and has an attached exterior layer 136. The exterior layer 136 may be made of any suitable material, such as an adhering coating of plastic or rubber, which includes a nonslippery surface 137 to rest against the concave surface 46 or 146.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A stand for adjustably supporting a trunk of a tree in a selected attitude, comprising:

(a) a clamp having a lower portion and including fastener means for attaching said clamp substantially immovably to a butt end portion of a tree trunk with said lower portion of said clamp downwardly adjacent said butt end of said tree trunk;

(b) a collar encircling said clamp snugly, above said lower portion thereof, and supporting said clamp, said collar extending radially outward about said clamp and having a downwardly-facing spherical convex surface said collar being removable from said clamp and defining a generally cylindrical circular opening therethrough and having a chamfered portion at an upper end of said opening, and said clamp including a portion which fits snugly within said cylindrical circular opening and a tapered portion which rests against said chamfered portion, preventing said clamp from rotating freely with respect to said collar when a tree is held in said clamp and supported by said stand;

(c) a base including a water pan having a bottom; and (d) a socket of fixed size supported by said base in a location above said water pan, said socket supporting said collar and said clamp and including an upwardly-facing annular spherical concave surface, said clamp extending downward through said socket into said water pan and said lower portion of said clamp being located at least a small distance above said bottom of said water pan, and frictional interaction between said convex surface and said annular concave surface holding said collar in a desired orientation with respect to said socket.

2. The stand of claim 1 wherein at least one of said convex surface and said concave surface is roughened and enhances friction in said engagement of said concave surface with said convex surface to resist relative movement between said collar and said socket and thus to maintain said trunk of said tree in said selected attitude.

3. The stand of claim 1 wherein said base further includes, located above said socket, a pressure-exerting pad selectively adjustable to exert pressure against said convex surface of said collar to assist in holding said collar in said desired orientation with respect to said socket.

4. The stand of claim 1 wherein said convex surface and said concave surface are of similar radius and fit nestingly together with said collar in said desired orientation with respect to said socket.

5. The stand of claim 1 wherein said collar has a friction-enhancing coating forming said convex surface.

6. The stand of claim 1 wherein said concave surface of said socket is rough.

7. The stand of claim 6 wherein said concave surface includes a plurality of engagement points.

* * * * *